US012371981B2

(12) United States Patent
Tan et al.

(10) Patent No.: US 12,371,981 B2
(45) Date of Patent: Jul. 29, 2025

(54) PREDICTION METHOD FOR CONSTANT PRODUCTION DECLINE OF WATER-PRODUCING GAS WELL IN HIGHLY HETEROGENEOUS RESERVOIR

(71) Applicant: Southwest Petroleum University, Chengdu (CN)

(72) Inventors: Xiaohua Tan, Chengdu (CN); Daijin Zhuang, Chengdu (CN); Mingqing Kui, Chengdu (CN); Qian Li, Chengdu (CN); Fei Zhang, Chengdu (CN); Tao Li, Chengdu (CN); Zhenglin Mao, Chengdu (CN); Yan Zhang, Chengdu (CN); Xiaoping Li, Chengdu (CN); Miaofeng Cui, Chengdu (CN); Xian Peng, Chengdu (CN); Longxin Li, Chengdu (CN); Xixiang Liu, Chengdu (CN); Zihan Zhao, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 377 days.

(21) Appl. No.: 17/812,106

(22) Filed: Jul. 12, 2022

(65) Prior Publication Data

US 2023/0017069 A1 Jan. 19, 2023

(30) Foreign Application Priority Data

Jul. 13, 2021 (CN) ..... 202110787098.X

(51) Int. Cl.

| | |
|---|---|
| ***E21B 43/20*** | (2006.01) |
| ***E21B 49/08*** | (2006.01) |
| *E21B 47/07* | (2012.01) |

(52) U.S. Cl.
CPC ..... *E21B 43/20* (2013.01); *E21B 49/0875* (2020.05); *E21B 47/07* (2020.05); *E21B 2200/20* (2020.05); *E21B 2200/22* (2020.05)

(58) Field of Classification Search
CPC ..... E21B 43/20; E21B 49/0875; E21B 47/07; E21B 2200/20
See application file for complete search history.

(56) References Cited

U.S. PATENT DOCUMENTS 6,101,447 A * 8/2000 Poe, Jr. ..... E21B 49/00 702/13
10,480,315 B2 * 11/2019 Gottumukkala ..... E21B 49/087
(Continued)

*Primary Examiner* — Ricky Go
(74) *Attorney, Agent, or Firm* — Addison D. Ault; IPGentleman Intellectual Property Services, LLC

(57) ABSTRACT

The present disclosure relates to a prediction method for constant production decline of a water-producing gas well in a highly heterogeneous reservoir. The prediction method mainly includes: collecting related data of a target water-producing gas well, fitting to obtain a water-drive constant and a water invasion constant, fitting dynamic reserves by adopting a Blasingame plotting method, conducting fitting by adopting a dual-medium model to obtain an elastic storativity ratio and an interporosity flow coefficient, calculating a reservoir heterogeneity coefficient, obtaining a flowing bottomhole pressure at the later stage of stable production, calculating formation pressure of a new day through quantitative production of the target water-producing gas well with 1 day as an iteration stride, performing iteration until the formation pressure is less than or equal to the formation pressure at the end of stable production, and drawing a prediction curve about constant production decline of the target water-producing gas well.

3 Claims, 3 Drawing Sheets

(56) References Cited

U.S. PATENT DOCUMENTS

| | | | | |
|---|---|---|---|---|
| 2003/0225522 | A1* | 12/2003 | Poe | E21B 43/00 702/11 |
| 2016/0145994 | A1* | 5/2016 | Li | E21B 41/00 702/6 |
| 2021/0002999 | A1* | 1/2021 | Yue | E21B 49/00 |

* cited by examiner

PREDICTION METHOD FOR CONSTANT PRODUCTION DECLINE OF WATER-PRODUCING GAS WELL IN HIGHLY HETEROGENEOUS RESERVOIR

CROSS REFERENCE TO RELATED APPLICATION

This patent application claims the benefit and priority of Chinese Patent Application No. 202110787098.X, filed on Jul. 13, 2021, the disclosure of which is incorporated by reference herein in its entirety as part of the present application.

TECHNICAL FIELD

The present disclosure belongs to the field of gas reservoir development, and in particular to a prediction method for constant production decline of a water-producing gas well in a highly heterogeneous reservoir.

BACKGROUND ART

Natural gas is considered to be a safer energy overall. There are various advantages of natural gas. For example, the use of natural gas can reduce the consumption of coal and petroleum, which alleviates environmental pollution to a great extent. Besides, it is helpful to cut down emissions of carbon dioxide, sulfur dioxide and dust, thereby reducing acid rain and fundamentally improving environmental quality. Therefore, natural gas exploitation has become particularly important. However, for a water-producing gas well in a highly heterogeneous reservoir, both strong heterogeneity and water production of the reservoir may cause changes in gas well production, resulting in the decline of natural gas well production different from conventional gas wells. Therefore, how to evaluate reservoir heterogeneity and decline of gas well production has become a breakthrough point in gas reservoir development.

At present, Chinese Patent CN201410638125.7 (entitled OIL AND GAS WELL PRODUCTION DECLINE ANALYSIS METHOD AND SYSTEM) provides an oil and gas well production decline analysis method and system that can be applied to production analysis and dynamic evaluation of shale gas wells and other types of oil and gas wells; however, this method is only intended to predict the production decline of gas wells without considering constant rate production in the process of actual gas well production, and the method fails to predict production of heterogeneous and water-producing gas wells. Chinese Patent CN201310314083.7 (entitled DYNAMIC ANALYSIS METHOD AND SYSTEM OF FRACTURE-CAVE CARBONATE GAS RESERVOIR) can predict the production performance of a fracture-cave heterogeneous gas reservoir in a mode of constant rate production, but cannot predict the production performance of a water-producing gas well. Therefore, in order to establish a better prediction method for constant production decline of a water-producing gas well in a highly heterogeneous reservoir, dynamic prediction is carried out on constant rate production of the water-producing gas well in the highly heterogeneous reservoir.

SUMMARY

An objective of the present disclosure is to achieve production performance prediction of gas wells in highly-heterogeneous water-producing gas reservoirs under the condition of constant rate production, and to form a prediction method for constant production decline of a water-producing gas well in a highly heterogeneous reservoir, so as to lay a foundation for gas reservoir development.

The present disclosure adopts the technical solutions as follows.

S100, collecting from a target water-producing gas well an original formation pressure $p_i$, a wellhead transmission pressure $p_t$, point-measured static pressure data $p_j$, a cumulative gas production $G_{pj}$ corresponding to the point-measured static pressure, a formation temperature $T_i$, a wellhead temperature t, a middle depth h of a wellbore production layer, a wellbore radius $r_w$, an open-flow capacity $q_{AOF}$, a current cumulative gas production $G_p$, a cumulative water production $W_p$, a daily gas production $q_g$, a daily water production $q_w$, a relative density $\gamma_g$ of gas samples, a mole fraction $y_{N2}$ of nitrogen, a mole fraction $yC_{O2}$ of carbon dioxide, a mole fraction $y_{H2S}$ of hydrogen sulfide, a relative density $\gamma_w$ of water samples, and a mole fraction $y_{Na}C_l$ of sodium chloride;

S200, based on the daily cumulative water production and the daily cumulative gas production, obtaining a water-drive constant a and a water-drive constant b, and obtaining a type-A water-drive formula of a target water-producing gas well;

S300, conducting fitting by a Blasingame plotting method to obtain dynamic reserves G of the target water-producing gas well, and obtaining a reserves recovery degree $R_j$ corresponding to the point-measured static pressure by dividing the dynamic reserves of the target water-producing gas well by the cumulative gas production corresponding to the point-measured static pressure;

S400, collecting pressure recovery well testing data of the target water-producing gas well to carry out pressure recovery well testing analysis, and calculating a heterogeneity coefficient D of a reservoir at which the target water-producing gas well is located; where specific procedures are as follows: first, based on pressure data over well testing obtained by pressure recovery well testing on the target water-producing gas well, conducting data fitting by adopting a dual-medium model to obtain an elastic storativity ratio ω and an interporosity flow coefficient λ; second, substituting the elastic storativity ratio ω and the interporosity flow coefficient λ obtained through fitting into $$D = \frac{\frac{ar^2}{\lambda}}{\frac{\alpha r_w^2}{\lambda}\left(\frac{\omega}{1-\omega}\right)+1}$$

to calculate the reservoir heterogeneity coefficient D, where a denotes a shape factor in $m^{-2}$ obtained from coring in the reservoir at which the target water-producing gas well is located; $r_w$ denotes a wellbore radius in m; λ denotes a unit-free interporosity flow coefficient; ω denotes a unit-free elastic storativity ratio; and D denotes a unit-free reservoir heterogeneity coefficient;

S500, according to the collected relative density $\gamma_g$ of gas, original formation pressure $p_i$ and point-measured static pressure data p, obtaining, by a D-A-K method, a deviation factor $z_i$ under an original formation pressure and a deviation factor z under a point-measured static pressure;

S600, according to a mass balance equation of water-sealed gas $$\frac{p/z}{p_i/z_i} = \frac{1 - DR^C - R}{1 - R^C},$$

calculating a water invasion constant C by a Newton's method, where p denotes point-measured static pressure data in MPa; z denotes a unit-free deviation factor under point-measured static pressure; $p_i$ denotes original formation pressure in MPa; $z_i$ denotes a unit-free deviation factor under original formation pressure; D denotes a unit-free reservoir heterogeneity coefficient; R denotes a unit-free reserves recovery degree; and C denotes a unit-free water invasion constant; and the specific procedures are as follows: first, based on the mass balance equation of water-sealed gas, obtaining a formula $$f(C) = \frac{1 - DR^C - R}{1 - R^C} - \frac{p/z}{p_i/z_i}$$

in which the water invasion constant C is taken as an unknown quantity, where f(C) denotes a formula representing the water invasion constant C; second, based on f(C), taking the derivative of the water invasion constant C to obtain, $$f'(C) = \frac{(1 - DR^C - R)(R^C \ln R) - (1 - R^C)(DR^C \ln R)}{(1 - R^C)^2},$$

where f'(C) denotes a unit-free formula obtained after taking the derive of the water invasion constant C by f(C); third, setting the water invasion constant C as 1, substituting C into f(C) and f'(C), and subtracting a ratio of f(C) to f'(C) by C to calculate a new water invasion constant $C_1$; fourth, calculating an absolute difference between C and $C_1$, and if the absolute difference between C and $C_1$ is less than 0.00001, then taking $C_1$ as a water invasion constant of the target water-producing gas well; if the absolute difference between C and $C_1$ is greater than 0.00001, replacing C with $C_1$ and substituting $C_1$ into f(C) and f'(C) to obtain a new water invasion constant $C_1$, and repeating until the absolute difference between C and $C_1$ is less than 0.00001 to obtain a final water invasion constant C of the target gas well; and

S700, predicting constant production decline of the target water-producing gas well to obtain a stable production period of the target water-producing gas well under a condition of constant rate production, where specific procedures are as follows: first, by a Hagedom-Brown method, substituting the original formation pressure $p_i$, wellhead transmission pressure $p_t$, formation temperature $T_i$, wellhead temperature t, middle depth h of wellbore production layer, wellbore radius $r_w$, daily gas production $q_g$, daily water production $q_w$, relative density $\gamma_g$ of gas samples, mole fraction $y_{N2}$ of nitrogen, mole fraction $y_{CO2}$ of carbon dioxide, mole fraction $y_{H2S}$ of hydrogen sulfide, relative density $\gamma_w$ of water samples and mole fraction $y_{NaCl}$ of sodium chloride to obtain flowing bottomhole pressure $p_{wfmin}$ under wellhead transmission pressure, namely flowing bottomhole pressure $p_{wfmin}$ at the end of a stable production period; second, calculating, according to a one-point formula, a formation pressure $p_{min}$ at the later stage of stable production under the flowing bottomhole pressure $p_{wfmin}$ at the later stage of stable production; third, obtaining the reserves recovery degree R by dividing the current cumulative gas production of the target water-producing gas well by the dynamic reserves of the target water-producing gas well, and obtaining a current formation pressure p and a compression factor z corresponding to the current formation pressure based on the mass balance equation of water-sealed gas and the D-A-K method; fourth, quantifying production of the target water-producing gas well by $q_g$ with 1 day as an iteration stride, obtaining a cumulative gas production of a new day by superimposing $G_p$, substituting the new cumulative gas production into the type-A water-drive formula of the target water-producing gas well to calculate a cumulative water production of a new day, obtaining a formation pressure of a new day based on the mass balance equation of water-sealed gas and the D-A-K method, performing iteration until the formation pressure of the new day is less than or equal to the formation pressure $p_{min}$ at the later stage of stable production, inversely calculating flowing bottomhole pressure by substituting into the one-point formula, and drawing a curve of a flowing bottomhole pressure over time to obtain a curve predicting constant production decline of the target water-producing gas well; and fifth, obtaining the stable production period of the target water-producing gas well by dividing an end time of the iteration by 365 days.

According to the prediction method for constant production decline of a water-producing gas well in a highly heterogeneous reservoir, the Blasingame plotting method refers to a process of inputting, by F.A.S.T.RTA software, the production data, original formation pressure, formation temperature, middle depth of a wellbore production layer, and a wellbore radius of the target water-producing gas well, fitting an actual production curve on a theoretical curve plot, and then automatically calculating the dynamic reserves of the target water-producing gas well by the F.A.S.T.RTA software.

According to the prediction method for constant production decline of a water-producing gas well in a highly heterogeneous reservoir, the D-A-K method refers to a following process: based on relative density $\gamma_g$ of gas samples, calculating, by empirical formulas $p_{pc}=(46.7-32.1\times(\gamma_g-0.5))\times 0.09869$ and $T_{pc}=171\times(\gamma_g-0.5)+182$, pseudocritical pressure $p_{pc}$ and pseudocritical temperature $T_{pc}$, then based on a formation pressure $p_k$ and a formation temperature $T_k$, calculating, by $P_{pr}=p_k/p_{pc}$ and $T_{pr}=T_k/T_{pc}$, a pseudoreduced pressure $p_{pr}$ and a pseudoreduced temperature $T_{pr}$, calculating a deviation factor by simultaneous iteration of three formulas $\rho_{pr}=0.27p_{pr}/(z_kT_{pr})$, $F(\rho_{pr})=-0.27\ p_{pr}/T_{pr}+\rho_{pr}+(A_1+A_2/T_{pr}+A_3/T_{pr}^3+A_4/T_{pr}^4+A_5/T_{pr}^5)\rho_{pr}^2+(A_6+A_7/T_{pr}+A_8/T_{pr}^2)\rho_{pr}^3-A_9(A_7/T_{pr}+A_8/T_{pr}^2)\rho_{pr}^6+A_{10}(1+A_{11}\rho_{pr}^2)(\rho_{pr}^3/T_{pr}^3)\exp(-A_{11}\rho_{pr}^2)$, and $F'(\rho_{pr})=1+2(A_1+A_2/T_{pr}+A_3/T_{pr}^3+A_4/T_{pr}^4+A_5/T_{pr}^5)\rho_{pr}+3(A_6+A_7/T_{pr}+A_8/T_{pr}^2)\ \rho_{pr}^2-6A_9(A_7/T_{pr}+A_8/T_{pr}^2)\rho_{pr}^5+(A_{10}+T_{pr}^3[3\rho_{pr}^2+A_{11}\ (3\rho_{pr}^4-2A_{11}\rho_{pr}^6)]\exp(-A_{11}\rho_{pr}^2)$, where $\gamma_g$ denotes a unit-free relative density of gas samples; $p_{pc}$ denotes a pseudocritical pressure in MPa; $T_{pc}$ denotes a pseudocritical temperature in K; $p_k$ denotes a formation pressure in MPa; $T_k$ denotes a formation temperature in K; $p_{pr}$ denotes a pseudoreduced pressure in MPa; $T_{pr}$ denotes a pseudoreduced temperature in K; $\rho_{pr}$ denotes a unit-free pseudoreduced density; $z_k$ denotes a unit-free deviation factor corresponding to a formation pressure; $F(\rho_{pr})$ is a unit-free formula representing pseudoreduced density; $A_1$=0.3265, free of unit; $A_2$=−1.0700, free of unit; $A_3$=−0.5339, free of unit; $A_4$=0.01569, free of unit; $A_5$=−0.05165, free of unit; $A_6$=0.5475, free of unit; $A_7$=−0.7361, free of unit; $A_8$=0.1844, free of unit; $A_9$=0.1056, free of unit; $A_{10}$=0.6134, free of unit; $A_{11}$=0.7210, free of unit; $F'(\rho_{pr})$ is a formula obtained after taking the derivative of $\rho_{pr}$ by $F(\rho_{pr})$, free of unit.

According to the prediction method for constant production decline of a water-producing gas well in a highly heterogeneous reservoir, Hagedom-Brown method refers to a process of calculating a flowing bottomhole pressure based on $$\frac{\Delta p}{\Delta H} = 10^{-6}\left(\rho_m g + f_m \frac{G_{mA}^2}{4r_w^2\rho_m}\right),\ \rho_m = \rho_w H_L + \rho_g(1-H_L),$$

$$1/\sqrt{f_m} = 1.14 - 2lg\left(e/2/r_w + 21.25/N_{Re}^{0.9}\right),$$

$$V_{sl} = \frac{q_w}{86400\pi r_w^2},\ V_{sg} = \frac{q_g}{86400\pi r_w^2},$$

$$G_{mA}^2 = V_{sl}\rho_w + V_{sg}\rho_g \text{ and } N_{Re} = \frac{(V_{sl}\rho_w + V_{sg}\rho_g)\times 2\times r_w}{\mu_w^{H_L}\times\mu_g^{(1-H_L)}},$$

where Δp denotes a well pipeline pressure increment in MPa; ΔH denotes a well pipeline depth increment in m; $\mu_m$ denotes density of an air-water mixture in kg/m$^3$; g denotes a gravitational acceleration in m/s$^2$; $f_m$ denotes a two-phase friction coefficient free of unit; $G_{mA}$ denotes a mass flow rate of a mixture per pipeline sectional area in kg/s/m$^2$; $r_w$ denotes a wellbore radius in m; $\rho_w$ denotes water density of a target water-producing gas well, which, from physical property analysis, has a unit of kg/m$^3$; $\rho_g$ denotes gas density of a target water-producing gas well, which, from physical property analysis, has a unit of kg/m$^3$; $H_L$ denotes liquid holdup free of unit; e denotes an absolute roughness of a pipe wall, which, from pipe wall analysis, has a unit of m; $Nre_{Re}$ denotes a two-phase Reynolds number free of unit; $q_g$ denotes a daily gas production in m$^3$; $q_w$ denotes a daily water production in m$^3$; $V_{s1}$ denotes an apparent liquid velocity in m/s; $V_{sg}$ denotes an apparent gas velocity in m/s; $\mu_w$ denotes water viscosity, which, from physical property analysis, has a unit of mPa·s; and $\mu_g$ denotes gas viscosity, which, from physical property analysis, has a unit of mPa·s.

According to the prediction method for constant production decline of a water-producing gas well in a highly heterogeneous reservoir, the one-point formula is $$q_{AOF} = \frac{6q_g}{\sqrt{1 + 48\frac{p_{min}^2 - p_{wfmin}^2}{p_{min}^2} - 1}},$$

where $q_g$ denotes a daily gas production in m$^3$; $q_{AOF}$ denotes an open-flow capacity in m$^3$; $p_{mim}$ denotes a formation pressure pmin at the end of stable production in MPa; and $p_{wfmin}$ denotes a flowing bottomhole pressure at the end of stable production in MPa.

The technical solution of the present disclosure has the advantages that reservoir heterogeneity can be quantitatively evaluated in combination with well test analysis, production prediction is carried out on the highly heterogeneous water-producing gas well in view of its constant production, thus a stable production period of the gas well is obtained, which allows for prediction of constant production decline of the water-producing gas well in the highly heterogeneous reservoir.

DETAILED DESCRIPTION OF THE EMBODIMENTS

The present disclosure will be explained in detail below with reference to the accompanying drawings.

Figure 1:
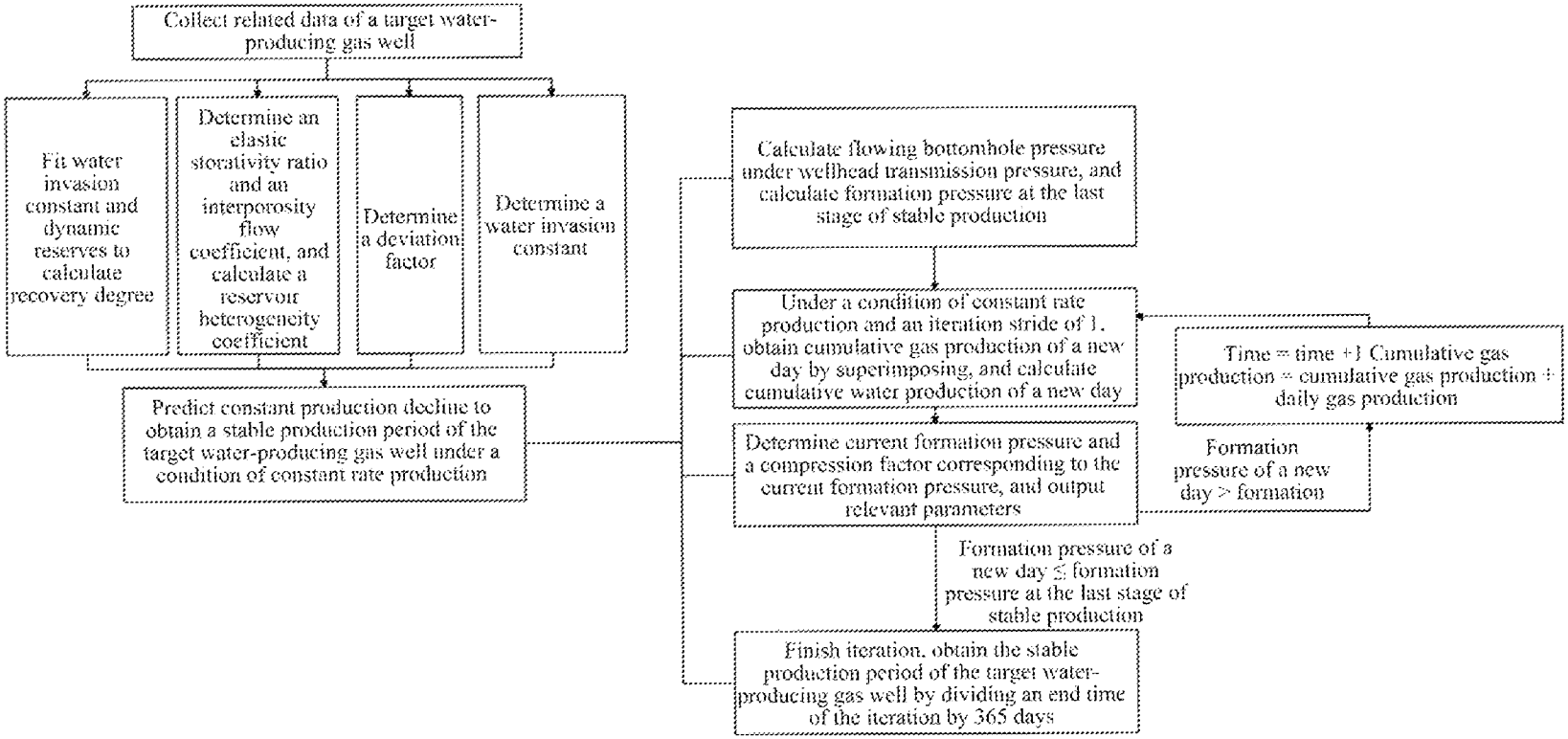
FIG. 1 is a flowchart of a prediction method for constant production decline of a water-producing gas well in a highly heterogeneous reservoir.

The present disclosure provides a prediction method for constant production decline of a water-producing gas well in a highly heterogeneous reservoir. FIG. 1 is a flowchart of the method. The evaluation method includes the following steps:

S100, collecting from a target water-producing gas well an original formation pressure $p_i$, a wellhead transmission pressure $p_t$, point-measured static pressure data $p_j$, a cumulative gas production $G_{pj}$ corresponding to the point-measured static pressure, a formation temperature $T_i$, a wellhead temperature t, a middle depth h of a wellbore production layer, a wellbore radius $r_w$, an open-flow capacity $q_{AOF}$, a current cumulative gas production $G_p$, a cumulative water production $W_p$, a daily gas production $q_g$, a daily water production $q_w$, a relative density $\gamma_g$ of gas samples, a mole fraction $y_{N2}$ of nitrogen, a mole fraction $y_{CO2}$ of carbon dioxide, a mole fraction $y_{H2S}$ of hydrogen sulfide, a relative density $\gamma_w$ of water samples, and a mole fraction $y_{NaCl}$ of sodium chloride;

S200, based on the daily cumulative water production and the daily cumulative gas production, obtaining a water-drive constant a and a water-drive constant b, and obtaining a type-A water-drive formula of a target water-producing gas well;

S300, conducting fitting by a Blasingame plotting method to obtain dynamic reserves G of the target water-producing gas well, and obtaining a reserves recovery degree $R_j$ corresponding to the point-measured static pressure by dividing the dynamic reserves of the target water-producing gas well by the cumulative gas production corresponding to the point-measured static pressure;

S400, collecting pressure recovery well testing data of the target water-producing gas well to carry out pressure recovery well testing analysis, and calculating a heterogeneity coefficient D of a reservoir at which the target water-producing gas well is located; where specific procedures are as follows: first, based on pressure data over well testing obtained by pressure recovery well testing on the target water-producing gas well, conducting data fitting by adopting a dual-medium model to obtain an elastic storativity ratio ω and an interporosity flow coefficient λ; second, substituting the elastic storativity ratio ω and the interporosity flow coefficient λ obtained through fitting into $$D = \frac{\frac{\alpha r_w^2}{\lambda}}{\frac{\alpha r_w^2}{\lambda}\left(\frac{\omega}{1-\omega}\right)+1}$$

to calculate the reservoir heterogeneity coefficient D, where a denotes a shape factor in $m^{-2}$ obtained from coring in the reservoir at which the target water-producing gas well is located; $r_w$ denotes a wellbore radius in m; λ denotes a unit-free interporosity flow coefficient; w denotes a unit-free elastic storativity ratio; and D denotes a unit-free reservoir heterogeneity coefficient;

S500, according to the collected relative density $\gamma_g$ of gas, original formation pressure $p_i$ and point-measured static pressure data p, obtaining, by a D-A-K method, a deviation factor $z_i$ under an original formation pressure and a deviation factor z under a point-measured static pressure;

S600, according to a mass balance equation of water-sealed gas $$\frac{p/z}{p_i/z_i} = \frac{1-DR^C-R}{1-R^C},$$

calculating a water invasion constant C by a Newton's method, where p denotes point-measured static pressure data in MPa; z denotes a unit-free deviation factor under point-measured static pressure; $p_i$ denotes original formation pressure in MPa; $z_i$ denotes a unit-free deviation factor under original formation pressure; D denotes a unit-free reservoir heterogeneity coefficient; R denotes a unit-free reserves recovery degree; and C denotes a unit-free water invasion constant; and the specific procedures are as follows: first, based on the mass balance equation of water-sealed gas, obtaining a formula $$f(C) = \frac{1-DR^C-R}{1-R^C} - \frac{p/z}{p_i/z_i}$$

in which the water invasion constant C is taken as an unknown quantity, where f(C) denotes a formula representing the water invasion constant C; second, based on f(C), taking the derivative of the water invasion constant C to obtain $$f'(C) = \frac{(1-DR^C-R)(R^C\ln R)-(1-R^C)(DR^C\ln R)}{(1-R^C)^2},$$

where f'(C) denotes a unit-free formula obtained after taking the derive of the water invasion constant C by f(C); third, setting the water invasion constant C as 1, substituting C into f(C) and f'(C), and subtracting a ratio of f(C) to f'(C) by C to calculate a new water invasion constant $C_1$; fourth, calculating an absolute difference between C and $C_1$, and if the absolute difference between C and $C_1$ is less than 0.00001, then taking $C_1$ as a water invasion constant of the target water-producing gas well; if the absolute difference between C and $C_1$ is greater than 0.00001, replacing C with $C_1$ and substituting $C_1$ into f(C) and f'(C) to obtain a new water invasion constant $C_1$, and repeating until the absolute difference between C and $C_1$ is less than 0.00001 to obtain a final water invasion constant C of the target gas well; and

S700, predicting constant production decline of the target water-producing gas well to obtain a stable production period of the target water-producing gas well under a condition of constant rate production, where specific procedures are as follows: first, by a Hagedom-Brown method, substituting the original formation pressure $p_i$, wellhead transmission pressure $p_t$, formation temperature $T_i$, wellhead temperature t, middle depth h of wellbore production layer, wellbore radius $r_w$, daily gas production $q_g$, daily water production $q_w$, relative density $\gamma_g$ of gas samples, mole fraction $y_{N2}$ of nitrogen, mole fraction $y_{CO2}$ of carbon dioxide, mole fraction $y_{H2S}$ of hydrogen sulfide, relative density $\gamma_w$ of water samples and mole fraction $y_{NaCL}$ of sodium chloride to obtain flowing bottomhole pressure $p_{wfmin}$ under wellhead transmission pressure, namely flowing bottomhole pressure $p_{wfmin}$ at the end of a stable production period; second, calculating, according to a one-point formula, a formation pressure $p_{min}$ at the later stage of stable production under the flowing bottomhole pressure $p_{wfmin}$ at the later stage of stable production; third, obtaining the reserves recovery degree R by dividing the current cumulative gas production of the target water-producing gas well by the dynamic reserves of the target water-producing gas well, and obtaining a current formation pressure p and a compression factor z corresponding to the current formation pressure based on the mass balance equation of water-sealed gas and the D-A-K method; fourth, quantifying production of the target water-producing gas well by $q_g$ with 1 day as an iteration stride, obtaining a cumulative gas production of a new day by superimposing $G_p$, substituting the new cumulative gas production into the type-A water-drive formula of the target water-producing gas well to calculate a cumulative water production of a new day, obtaining a formation pressure of a new day based on the mass balance equation of water-sealed gas and the D-A-K method, performing iteration until the formation pressure of the new day is less than or equal to the formation pressure $p_{min}$ at the later stage of stable production, inversely calculating flowing bottomhole pressure by substituting into the one-point formula, and drawing a curve of a flowing bottomhole pressure over time to obtain a curve predicting constant production decline of the target water-producing gas well; and fifth, obtaining the stable production period of the target water-producing gas well by dividing an end time of the iteration by 365 days.

Further, according to the prediction method for constant production decline of a water-producing gas well in a highly heterogeneous reservoir, the Blasingame plotting method refers to a process of inputting, by F.A.S.T.RTA software, the production data, original formation pressure, formation temperature, middle depth of a wellbore production layer, and a wellbore radius of the target water-producing gas well, fitting an actual production curve on a theoretical curve plot, and then automatically calculating the dynamic reserves of the target water-producing gas well by the F.A.S.T.RTA software.

Further, according to the prediction method for constant production decline of a water-producing gas well in a highly heterogeneous reservoir, the D-A-K method refers to a following process: based on relative density $\gamma_g$ of gas samples, calculating, by empirical formulas $p_{pc}=(46.7-32.1\times(\gamma_g-0.5)\times0.09869$ and $T_{pc}=171\times(\gamma_g-0.5)+182$, pseudocritical pressure $p_{pc}$ and pseudocritical temperature $T_{pc}$, then based on a formation pressure $p_k$ and a formation temperature $T_k$, calculating, by $p_{pr}=p_k/p_{pc}$ and $T_{pr}=T_k/T_{pc}$, a pseudoreduced pressure $p_{pr}$ and a pseudoreduced temperature $T_{pr}$, calculating a deviation factor by simultaneous iteration of three formulas $\rho_{pr}=0.27p_{pr}/(z_kT_{pr})$, $F(\rho_{pr})=-0.27\ p_{pr}/T_{pr}+\rho_{pr}+(A_1+A_2/T_{pr}+A_3/T_{pr}^3+A_4/T_{pr}^4+A_5/T_{pr}^5)\rho_{pr}^2+(A_6+A_7/T_{pr}+A_8/T_{pr}^2)\rho_{pr}^3-A_9(A_7/T_{pr}+A_8/T_{pr}^2)\rho_{pr}^6+A_{10}(1+A_{11}\rho_{pr}^2)(\rho_{pr}^3/T_{pr}^3)\exp(-A_{11}\rho_{pr}^2)$, and $F'(\rho_{pr})=1+2(A_1+A_2/T_{pr}+A_3/T_{pr}^3+A_4/T_{pr}^4+A_5/T_{pr}^5)\rho_{pr}+3(A_6+A_7/T_{pr}+A_8/T_{pr}^2)\rho_{pr}^2-6A_9(A_7/T_{pr}+A_8/T_{pr}^2)\rho_{pr}^5+(A_{10}+T_{pr}^3[3\rho_{pr}^2+A_{11}(3\rho_{pr}^4-2A_{11}\rho_{pr}^6)]\exp(-A_{11}\rho_{pr}^2)$, where $\gamma_g$ denotes a unit-free relative density of gas samples; $p_{pc}$ denotes a pseudocritical pressure in MPa; $T_{pc}$ denotes a pseudocritical temperature in K; $p_k$ denotes a formation pressure in MPa; $T_k$ denotes a formation temperature in K; $p_{pr}$ denotes a pseudoreduced pressure in MPa; $T_{pr}$ denotes a pseudoreduced temperature in K; $\rho_{pr}$ denotes a unit-free pseudoreduced density; $z_k$ denotes a unit-free deviation factor corresponding to a formation pressure; $F(\rho_{pr})$ is a unit-free formula representing pseudoreduced density; $A_1=0.3265$, free of unit; $A_2=-1.0700$, free of unit; $A_3=-0.5339$, free of unit; $A_4=0.01569$, free of unit; $A_5=-0.05165$, free of unit; $A_6=0.5475$, free of unit; $A_7=-0.7361$, free of unit; $A_8=0.1844$, free of unit; $A_9=0.1056$, free of unit; $A_{10}=0.6134$, free of unit; $A_{11}=0.7210$, free of unit; $F'(\rho_{pr})$ is a formula obtained after taking the derivative of $\rho_{pr}$ by $F(\rho_{pr})$, free of unit.

Further, according to the prediction method for constant production decline of a water-producing gas well in a highly heterogeneous reservoir, Hagedom-Brown method refers to a process of calculating a flowing bottomhole pressure based on $$\frac{\Delta p}{\Delta H}=10^{-6}\left(\rho_m g+f_m\frac{G_{mA}^2}{4r_w^2\rho_m}\right),\ \rho_m=\rho_w H_L+\rho_g(1-H_L),$$

$$1/\sqrt{f_m}=1.14-2lg\left(e/2/r_w+21.25/N_{Re}^{0.9}\right),$$

$$V_{sl}=\frac{q_w}{86400\pi r_w^2},\ V_{sg}=\frac{q_g}{86400\pi r_w^2},$$

$$G_{mA}^2=V_{sl}\rho_w+V_{sg}\rho_g\ \text{and}\ N_{Re}=\frac{(V_{sl}\rho_w+V_{sg}\rho_g)\times2\times r_w}{\mu_w^{H_L}\times\mu_g^{(1-H_L)}},$$

where $\Delta p$ denotes a well pipeline pressure increment in MPa; $\Delta H$ denotes a well pipeline depth increment in m; $\mu_m$ denotes density of an air-water mixture in kg/m$^3$; g denotes a gravitational acceleration in m/s$^2$; $f_m$ denotes a two-phase friction coefficient free of unit; $G_{mA}$ denotes a mass flow rate of a mixture per pipeline sectional area in kg/s/m$^2$; $r_w$ denotes a wellbore radius in m; $\rho_w$ denotes water density of a target water-producing gas well, which, from physical property analysis, has a unit of kg/m$^3$; $\rho_g$ denotes gas density of a target water-producing gas well, which, from physical property analysis, has a unit of kg/m$^3$; $H_L$ denotes liquid holdup free of unit; e denotes an absolute roughness of a pipe wall, which, from pipe wall analysis, has a unit of m; $N_{Re}$ denotes a two-phase Reynolds number free of unit; $q_g$ denotes a daily gas production in m$^3$; $q_w$ denotes a daily water production in m$^3$; $V_{s1}$ denotes an apparent liquid velocity in m/s; $V_{sg}$ denotes an apparent gas velocity in m/s; $\mu_w$ denotes water viscosity, which, from physical property analysis, has a unit of mPa·s; and $\mu_g$ denotes gas viscosity, which, from physical property analysis, has a unit of mPa·s.

Further, according to the prediction method for constant production decline of a water-producing gas well in a highly heterogeneous reservoir, the one-point formula is $$q_{AOF}=\frac{6q_g}{\sqrt{1+48\frac{p_{min}^2-p_{wfmin}^2}{p_{min}^2}-1}},$$

where $q_g$ denotes a daily gas production in m$^3$; $q_{AOF}$ denotes an open-flow capacity in m$^3$; $p_{min}$ denotes a formation pressure pmin at the end of stable production in MPa; and $p_{wfmin}$ denotes a flowing bottomhole pressure at the end of stable production in MPa.

The steps of a prediction method for constant production decline of a water-producing gas well in a highly heterogeneous reservoir are described. Take a highly heterogeneous water-producing gas well as an example, predict production performance of the gas well in a condition of constant rate production so as to determine the stable production period of the gas well.

Figure 2:
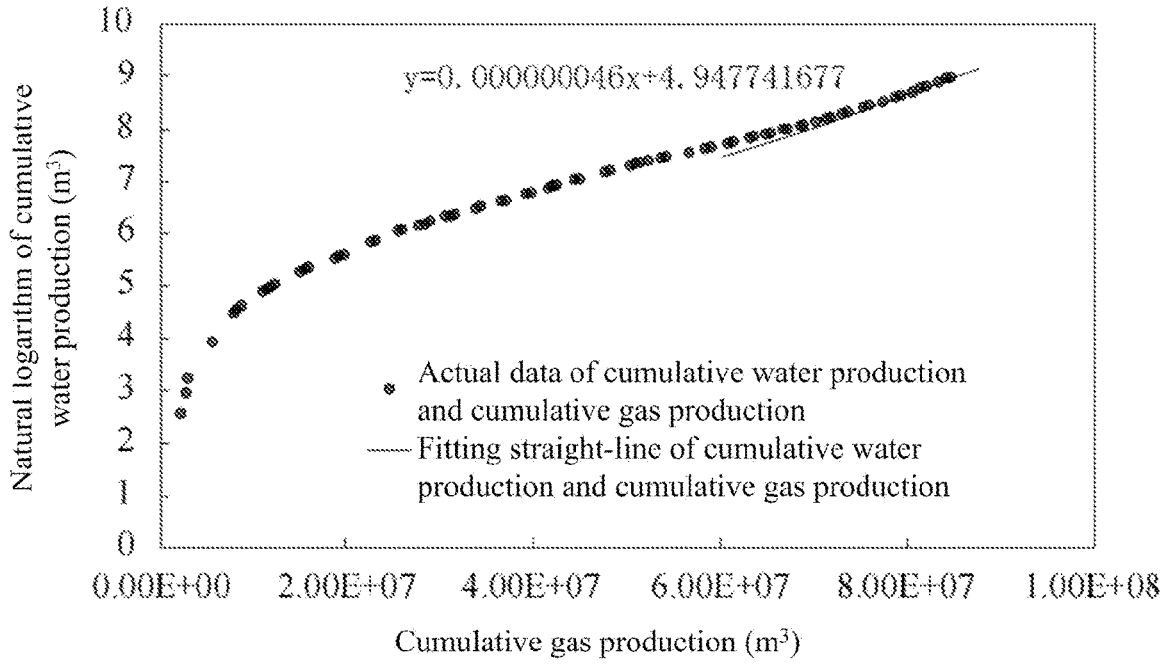
FIG. 2 is a Type A water-drive curve of a highly heterogeneous water-producing gas well.
Figure 3:
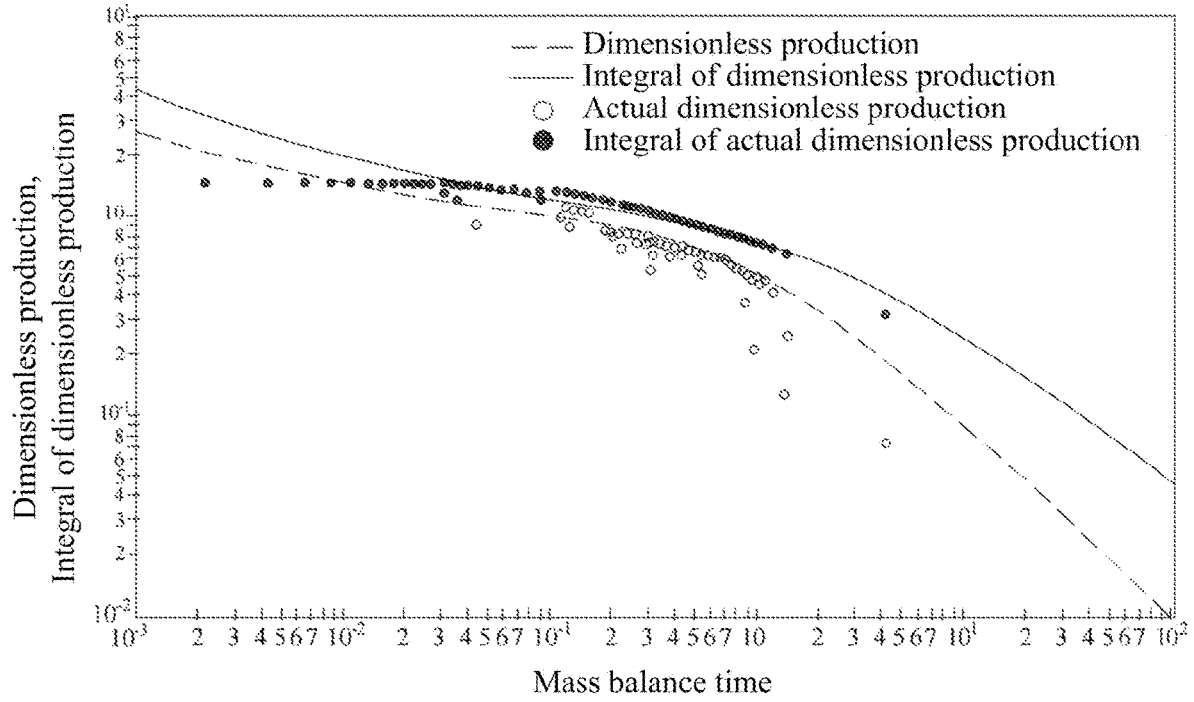
FIG. 3 is a Blasingame fitting plot of a highly heterogeneous water-producing gas well.
Figure 4:
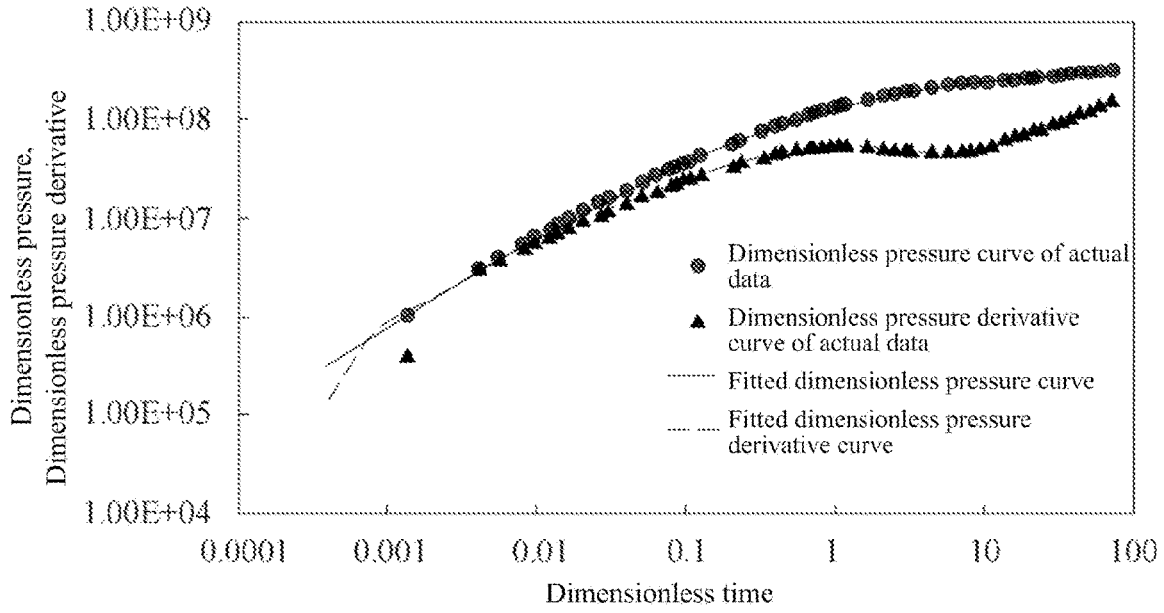
FIG. 4 is a dual-medium fitting diagram of a highly heterogeneous water-producing gas well.
Figure 5:
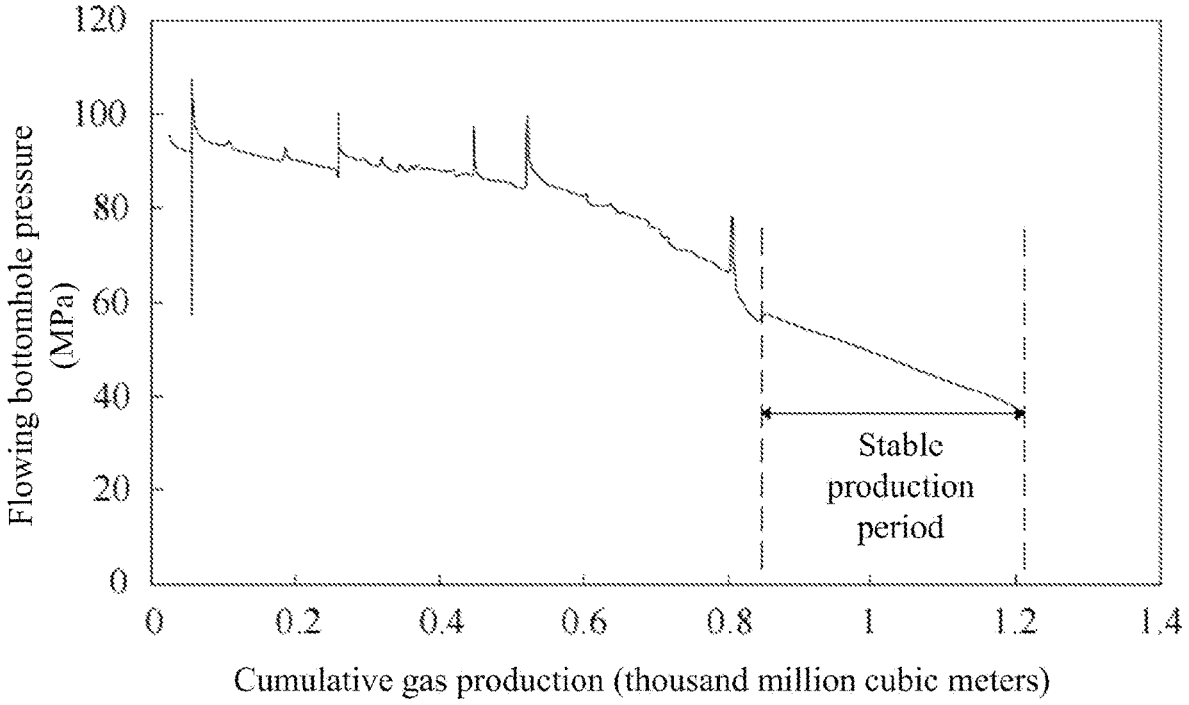
FIG. 5 is a curve predicting constant production decline of a highly heterogeneous water-producing gas well.

Collect production data, physical property analysis data and reservoir data of the highly heterogeneous water-producing gas well, and obtain water-drive constants a and b based on the type-A water-drive formula, where a=4.948, b=0.000000046, as shown in FIG. 2; by Blasingame plotting method, fit the dynamic reserves of the highly heterogeneous water-producing gas well to be 518000000 m$^3$, as shown in FIG. 3; then based on buildup well testing, conduct data fitting using the dual-medium model to obtain elastic storativity ratio of 0.223, interporosity flow coefficient of 0.00000111, and reservoir heterogeneity coefficient of 3.4842, as shown in FIG. 4; by D-A-K, solve a deviation factor 1.71 under original formation pressure; and based on the mass balance equation of water-sealed gas, calculate a water invasion constant 2 using Newton's method. Then calculate flowing bottomhole pressure under wellhead transmission pressure as 36.918 MPa by using Hagedom-Brown method, and calculate the formation pressure as 44.862 MPa at the last stage of stable production corresponding to flowing bottomhole pressure at the last stage of stable production to be according to one-point formula. Through the iteration of time stride, obtain curve of flowing bottomhole pressure over time, and finally obtain the curve predicting constant production decline of the target water-producing gas well, as shown in FIG. 5. According to the curve predicting constant production decline, it is concluded that the stable production period of a highly heterogeneous water-producing gas well is 1.115 years.

Compared with an existing prediction method for constant production of gas wells, the present disclosure has the following advantages: reservoir heterogeneity can be quantitatively evaluated in combination with well test analysis, production prediction is carried out on the highly heterogeneous water-producing gas well in view of its constant production, thus a stable production period of the gas well is obtained, which allows for prediction of constant production decline of the water-producing gas well in the highly heterogeneous reservoir.

Finally, it should be noted that the above examples are only intended to explain, rather than to limit the technical solutions of the present disclosure. Although the present disclosure is described in detail with reference to the preferred examples, those skilled in the art should understand that modifications or equivalent substitutions may be made to the technical solutions of the present disclosure without departing from the spirit and scope of the technical solutions of the present disclosure, and such modifications or equivalent substitutions should be included within the scope of the claims of the present disclosure.

What is claimed is:

1. A method of obtaining a stable production period of a water-producing gas well in a highly heterogeneous reservoir, comprising:

S100, collecting from a target water-producing gas well an original formation pressure $p_i$, a wellhead transmission pressure $p_t$, point-measured static pressure data $p_j$, a cumulative gas production $G_{pj}$ corresponding to the point-measured static pressure, a formation temperature $T_i$, a wellhead temperature t, a middle depth h of a wellbore production layer, a wellbore radius $r_w$, an open-flow capacity $q_{AOF}$, a current cumulative gas production $G_p$, a cumulative water production $W_p$, a daily gas production $q_g$, a daily water production $q_w$, a relative density $\gamma_g$ of gas samples, a mole fraction $y_{N2}$ of nitrogen, a mole fraction $y_{CO2}$ of carbon dioxide, a mole fraction $y_{H2S}$ of hydrogen sulfide, a relative density $\gamma_w$ of water samples, and a mole fraction $y_{NaCl}$ of sodium chloride;

S200, based on the daily cumulative water production and the daily cumulative gas production, obtaining a water-drive constant a and a water-drive constant b, and obtaining a type-A water-drive formula of a target water-producing gas well;

S300, conducting fitting by a Blasingame plotting method to obtain dynamic reserves G of the target water-producing gas well, and obtaining a reserves recovery degree $R_j$ corresponding to the point-measured static pressure by dividing the dynamic reserves of the target water-producing gas well by the cumulative gas production corresponding to the point-measured static pressure;

S400, collecting pressure recovery well testing data of the target water-producing gas well to carry out pressure recovery well testing analysis, and calculating a heterogeneity coefficient D of a reservoir at which the target water-producing gas well is located; wherein specific procedures are as follows: first, based on pressure data over well testing obtained by pressure recovery well testing on the target water-producing gas well, conducting data fitting by adopting a dual-medium model to obtain an elastic storativity ratio ω and an interporosity flow coefficient λ; second, substituting the elastic storativity ratio ω and the interporosity flow coefficient λ obtained through fitting into $$D = \frac{\frac{\alpha r_w^2}{\lambda}}{\frac{\alpha r_w^2}{\lambda}\left(\frac{\omega}{1-\omega}\right)+1}$$

to calculate the reservoir heterogeneity coefficient D, wherein α denotes a shape factor in $m^{-2}$ obtained from coring in the reservoir at which the target water-producing gas well is located; $r_w$ denotes a wellbore radius in m; λ denotes a unit-free interporosity flow coefficient; ω denotes a unit-free elastic storativity ratio; and D denotes a unit-free reservoir heterogeneity coefficient;

S500, according to the collected relative density $\gamma_g$ of gas, original formation pressure $p_i$ and point-measured static pressure data p, obtaining, by a D-A-K method, a deviation factor $z_i$ under an original formation pressure and a deviation factor z under a point-measured static pressure;

S600, according to a mass balance equation of water-sealed gas $$\frac{p/z}{p_i/z_i} = \frac{1-DR^C-R}{1-R^C},$$

calculating a water invasion constant C by a Newton's method, wherein p denotes point-measured static pressure data in MPa; z denotes a unit-free deviation factor under point-measured static pressure; $p_i$ denotes original formation pressure in MPa; $z_i$ denotes a unit-free deviation factor under original formation pressure; D denotes a unit-free reservoir heterogeneity coefficient; R denotes a unit-free reserves recovery degree; and C denotes a unit-free water invasion constant; and the specific procedures are as follows:

first, based on the mass balance equation of water-sealed gas, obtaining a formula $$f(C) = \frac{1-DR^C-R}{1-R^C} - \frac{p/z}{p_i/z_i}$$

in which the water invasion constant C is taken as an unknown quantity, wherein f(C) denotes a formula representing the water invasion constant C;

second, based on f(C), taking the derivative of the water invasion constant C to obtain $$f'(C) = \frac{(1-DR^C-R)(R^C\ln R)-(1-R^C)(DR^C\ln R)}{(1-R^C)^2},$$

wherein f'(C) denotes a unit-free formula obtained after taking the derive of the water invasion constant C by f(C);

third, setting the water invasion constant C as 1, substituting C into f(C) and f'(C), and subtracting a ratio of f(C) to f'(C) by C to calculate a new water invasion constant $C_1$; fourth, calculating an absolute difference between C and $C_1$, and if the absolute difference between C and $C_1$ is less than 0.00001, then taking $C_1$ as a water invasion constant of the target water-producing gas well; if the absolute difference between C and $C_1$ is greater than 0.00001, replacing C with $C_1$ and substituting $C_1$ into f(C) and f'(C) to obtain a new water invasion constant $C_1$, and repeating until the absolute difference between C and $C_1$ is less than 0.00001 to obtain a final water invasion constant C of the target gas well; and

S700, predicting constant production decline of the target water-producing gas well to obtain a stable production period of the target water-producing gas well under a condition of constant rate production, wherein specific procedures are as follows:

first, by a Hagedom-Brown method, substituting the original formation pressure $p_i$, wellhead transmission pressure $p_t$, formation temperature $T_i$, wellhead temperature t, middle depth h of wellbore production layer, wellbore radius $r_w$, daily gas production $q_g$, daily water production $q_w$, relative density $\gamma_g$ of gas samples, mole fraction $y_{N2}$ of nitrogen, mole fraction $y_{CO2}$ of carbon dioxide, mole fraction $y_{H2S}$ of hydrogen sulfide, relative density yw of water samples and mole fraction $y_{NaCl}$ of sodium chloride to obtain flowing bottomhole pressure $p_{wfmin}$ under wellhead transmission pressure, namely flowing bottomhole pressure $p_{wfmin}$ at the end of a stable production period;

second, calculating, according to a one-point formula, a formation pressure $p_{min}$ at the later stage of stable production under the flowing bottomhole pressure $p_{wfmin}$ at the later stage of stable production;

third, obtaining the reserves recovery degree R by dividing the current cumulative gas production of the target water-producing gas well by the dynamic reserves of the target water-producing gas well, and obtaining a current formation pressure p and a compression factor z corresponding to the current formation pressure based on the mass balance equation of water-sealed gas and the D-A-K method;

fourth, quantifying production of the target water-producing gas well by $q_g$ with 1 day as an iteration stride, obtaining a cumulative gas production of a new day by superimposing $G_p$, substituting the new cumulative gas production into the type-A water-drive formula of the target water-producing gas well to calculate a cumulative water production of a new day, obtaining a formation pressure of a new day based on the mass balance equation of water-sealed gas and the D-A-K method, performing iteration until the formation pressure of the new day is less than or equal to the formation pressure $p_{min}$ at the later stage of stable production, inversely calculating flowing bottomhole pressure by substituting into the one-point formula, and drawing a curve of a flowing bottomhole pressure over time to obtain a curve predicting constant production decline of the target water-producing gas well; and obtaining stable production of gas from the target water-producing gas well, by collecting gas over a stable production period for a curve predicting constant production decline of the target water-producing gas well at a stable production rate $q_g$, wherein the stable production period of the target water-producing gas well is equal to the end time of the iteration divided by 365 days.

2. The method of obtaining a stable production period of a water-producing gas well in a highly heterogeneous reservoir according to claim 1, wherein the Blasingame plotting method described in step S300 refers to a process of inputting, by F.A.S.T.RTA software, the production data, original formation pressure, formation temperature, middle depth of a wellbore production layer, and a wellbore radius of the target water-producing gas well, fitting an actual production curve on a theoretical curve plot, and then automatically calculating the dynamic reserves of the target water-producing gas well by the F.A.S.T.RTA software.

3. The method of obtaining a stable production period of a water-producing gas well in a highly heterogeneous reservoir according to claim 1, wherein the one-point formula described in step S700 is $$q_{AOF} = \frac{6q_g}{\sqrt{1 + 48\frac{p_{min}^2 - p_{wfmin}^2}{p_{min}^2} - 1}},$$

wherein $q_g$ denotes a daily gas production in $m^3$; $q_{AOF}$ denotes an open-flow capacity in $m^3$; $p_{min}$ denotes a formation pressure pmin at the end of stable production in MPa; and $p_{wfmin}$ denotes a flowing bottomhole pressure at the end of stable production in MPa.

* * * * *